United States Patent [19]

Waddell

[11] Patent Number: 4,648,225

[45] Date of Patent: Mar. 10, 1987

[54] SPLIT BENDING CROWN MOLDING

[76] Inventor: Thomas T. Waddell, 2515 Valleyview Ct., Sugar Land, Tex. 77479

[21] Appl. No.: 742,725

[22] Filed: Jun. 7, 1985

[51] Int. Cl.[4] ..... E04F 19/02

[52] U.S. Cl. ..... 52/288; 52/631; 52/716; 144/346; 144/349; 144/353

[58] Field of Search ..... 52/716, 311, 313, 288, 52/290, 631, 717.1, 416, 419, 557, 316, 555; 156/212, 92, 182; 144/346, 349, 353

[56] References Cited

U.S. PATENT DOCUMENTS

| | | | |
|---|---|---|---|
| 430,187 | 6/1890 | Kendall | 52/541 |
| 479,441 | 7/1892 | Marvick et al. | 52/541 X |
| 510,855 | 12/1893 | Grimstad | 52/313 |
| 1,770,599 | 7/1930 | Stoehr | 52/541 X |
| 2,078,039 | 4/1937 | Stoner | 52/541 X |
| 2,172,093 | 9/1939 | Thompson et al. | 52/631 X |
| 2,708,358 | 5/1955 | Schels | 52/541 |
| 3,481,092 | 12/1969 | Constantino | 52/288 |
| 4,425,171 | 1/1984 | Oosaka et al. | 156/64 |

FOREIGN PATENT DOCUMENTS

| | | | |
|---|---|---|---|
| 352418 | 8/1905 | France | 52/316 |
| 172984 | 2/1935 | Switzerland | 52/288 |
| 180325 | 1/1936 | Switzerland | 52/540 |
| 3696 | of 1877 | United Kingdom | 52/541 |
| 325969 | 3/1930 | United Kingdom | 52/540 |
| 462805 | 3/1937 | United Kingdom | 52/540 |

*Primary Examiner*—J. Karl Bell

[57] ABSTRACT

A split bending molding assembly is provided for finishing operations for buildings, such as crown molding for curved or straight walled building structures. The molding includes a plurality of molding strips which are assembled in place on the building structure to form a crown molding or other molding of desired decorative configuration, each molding strip forming a decorative surface segment. The molding strips are provided with cooperative cam surfaces enabling workmen to apply a prying force to a molding strip being installed to thus cause precision alignment of the molding strips as applied. When installed, the joints of the molding strips will intersect the decorative surface segments at an abrupt angle and will be almost invisible and only minimal surface preparation will be required to finish the molding assembly.

15 Claims, 8 Drawing Figures

FIG.1
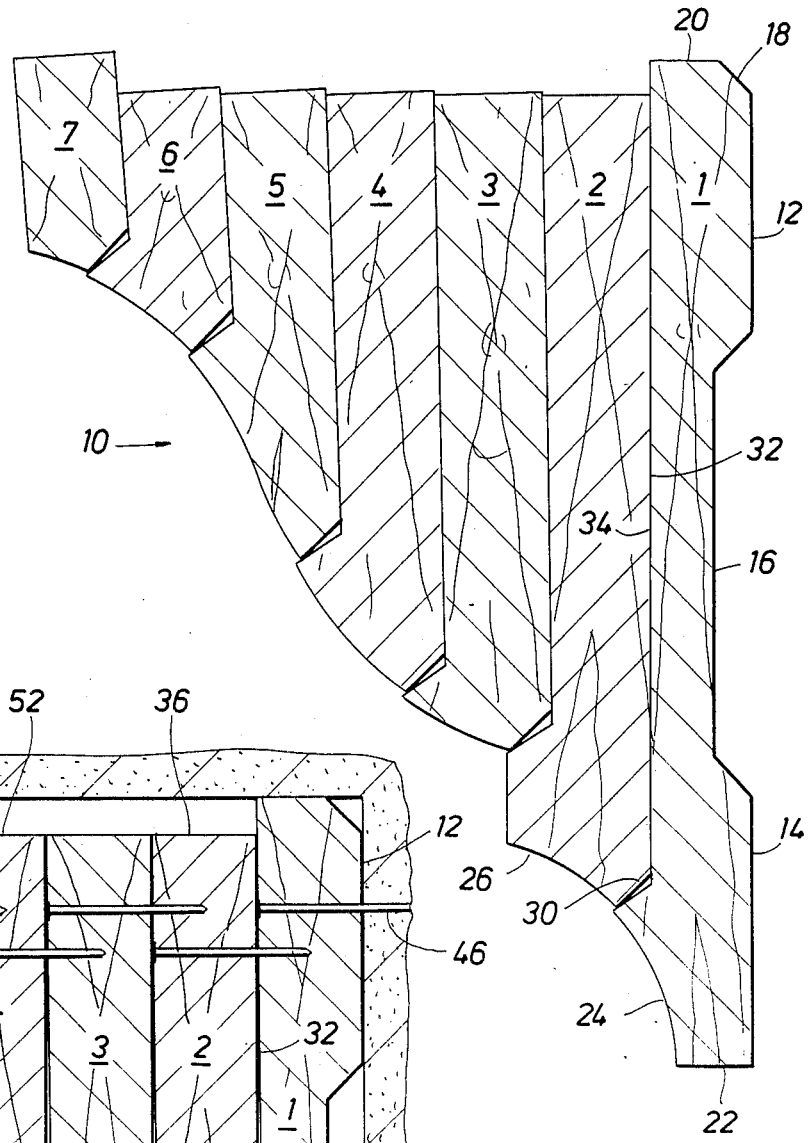
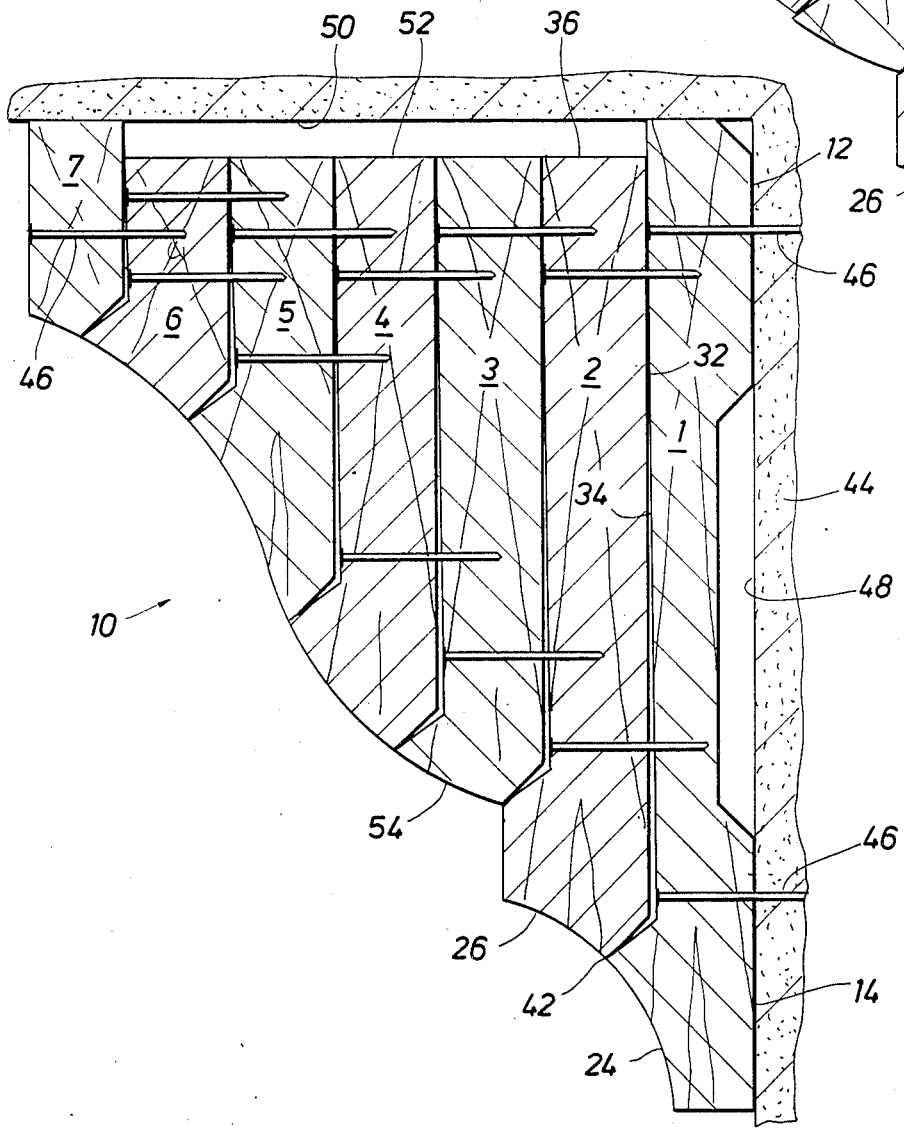
FIG.2

FIG. 3
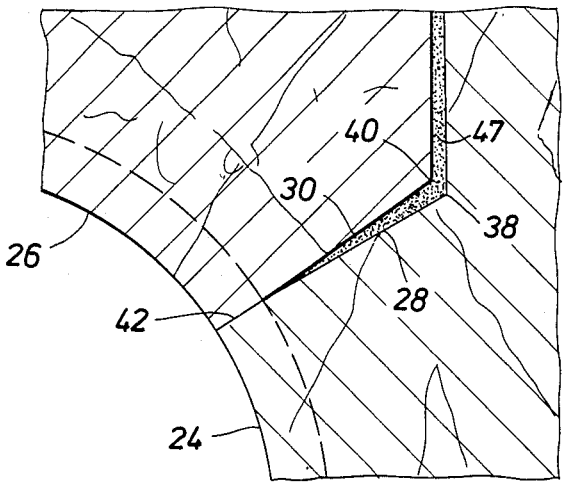
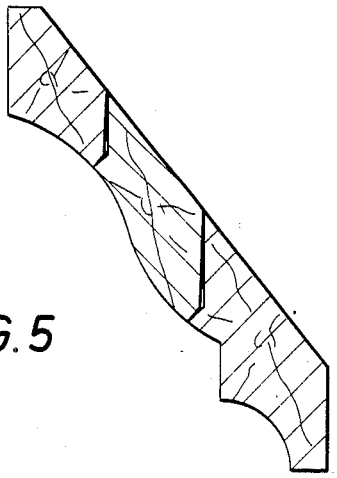
FIG. 5
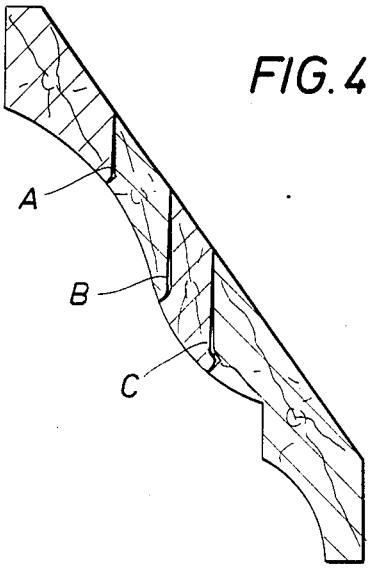
FIG. 4
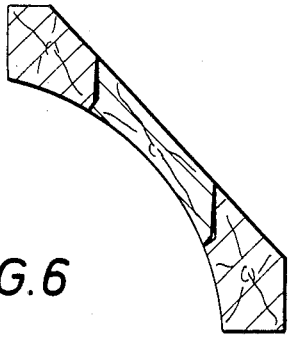
FIG. 6
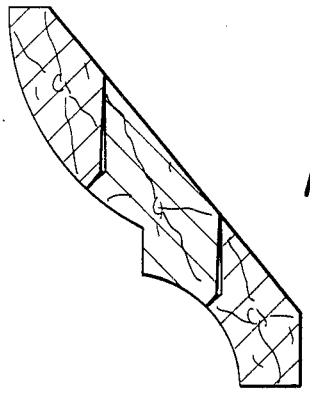
FIG. 7

SPLIT BENDING CROWN MOLDING

FIELD OF THE INVENTION

This invention is related generally to finishing molding for building structures and especially those building structures having unique convex or concave curved wall surfaces. More specifically, the present invention is directed to a laminated split bending crown molding or other similar molding which is formed by a plurality of molding strips, such as wood strips, which are installed in place in the building structure in a strip by strip manner such as to form a completed molding of desired configuration.

BACKGROUND OF THE INVENTION

In the construction of buildings including commercial buildings, homes, etc. crown molding is installed at the juncture of the walls and ceilings to form a decorative, pleasing finish for the building. When the walls of the building are straight, integral crown molding may be utilized quite successfully. In more elaborate building structures, such as those having convex or concave curved wall surfaces, integral crown molding cannot be applied in a single length. Since crown mold is applied 30°+ angular to wall surface, on a concave wall the edge touching the wall would have a considerably longer run than the edge touching the ceiling. Since wood has virtually no ability to stretch and only minute compression properties, the angular nature of its application precludes installation of straight pieces in a single length on a curved wall. Where curved wall surfaces are involved it is necessary to utilize crown molding that closely fits the curvature of the wall surface. A conventional method for installing curved crown molding is to assemble multiple short pieces of straight crown molding in end-to-end relation. Since this method of installation leaves multiple angulated joints, in order to achieve a smoothly curved surface configuration, a filler material is utilized to float in the various angulated joints that are created. A joint filling and floating operation of this nature is quite expensive because of the number of cuts that are made in the molding strip in order to adequately conform to the curvature of the wall surface. Considerable manual effort is required in order to fill, float and sand the various angulated joints and since the multiple pieces are in an angular end relation none of the lines characteristic to the mold are in a curved form to provide screed lines for floating. The resulting reality is a situation where a truly curved contour is impossible to achieve. A problem also occurs during temperature changes. Since wood and plaster filler material expand and contract differently in response to temperature changes and changes in humidity the plaster material will quite readily crack, giving the finished molding an undesirable appearance and requiring repair operations.

Another appraoch for developing curved crown moldings is to preform the crown molding to the desired radius of the wall surface to which the crown molding is to be applied. This is a very expensive procedure and is not generally satisfactory because the wall itself seldom is installed to the exact radius to which it is designed. In other words, prefabricated curved molding in most cases does not fit the intended wall surface and therefore expensive adjustments must be made in order to render them satisfactory. Such prefabricated molding is exceedingly expensive because it is usually milled from large wood pieces and there is significant waste involved. Since this method involves cutting curves out of straight logs, the grain direction dictates the length of pieces supplied. This causes there to be through butt-joints every 4 to 8 feet in crown mold. In addition, milling these logs in cross-grain manner causes the grain to raise up and produce a texture impossible to sand out, and thus showing through the paint.

SUMMARY OF THE INVENTION

It is therefore a primary feature of the present invention to provide a decorative molding which will establish precision fitting relation with the curved wall surfaces of a building structure.

It is another feature of this invention to provide a novel molding assembly which is capable of being applied in long uncut strips so as to minimize labor costs for the installation procedure and to provide a molding assembly which does not tend to crack due to thermal expansion and contraction.

It is another feature of this invention to provide a novel molding assembly and installation procedure for the same which is capable of being employed for a wide variety of moldings and assemblied wood structures.

A laminated, split bending molding is provided which is especially usable as crown molding for building structures having unique wall curvature of convex or concave form. The molding assembly, which is installed in place in the building structure, is defined by a plurality of rather thin molding strips. Each molding strip is provided with a decorative surface segment which cooperates with the decorative surface segment of other molding strips to form a molding of desired decorative configuration. Being thin, the molding strips, which are formed of wood or other suitable molding material, are readily deformable to the particular curvature of the wall surface involved. When used as crown molding each lamination of the molding structure defines a rear surface which is intended to be positioned in parallel relation with the plumb line of the wall surface. The front surfaces of each molding lamination are slightly relieved (angulated) with respect the rear surface. Each lamination is independently nailed or otherwise secured to the wall structure or to the adjacent molding strip. For example, the first lamination is formed to the curvature of the wall surface and nailed or otherwise fastened in place. Then the second lamination is bent to the curvature of the first lamination and tack nailed. After being properly aligned with the first lamination by a prying operation the second lamination is securely fastened in place by nailing or by other suitable means. The prying operation, in the presence of an adhesive functioning in its unsecured state as a lubricant, achieves camming of the strip being applied to achieve precision positioning of the adjacent decorative surface segments. Sequential laminations are installed in similar manner.

The portions of the molding strips adjacent to the decorative surface segments are angulated in a cooperative manner so as to define a camming activity as molding laminations are moved relative to one another. These cam surfaces are also oriented in abrupt angular relation at their juncture with the respective decorative surface thereof. These opposed angulated surfaces are further formed so as to define a triangular relief area between them. The opposed cam surfaces are also formed so that a particular spacing occurs at the juncture of the angulated surface with the respective front and rear surfaces of adjacent laminations. During assembly, installation personnel will use a pry bar or other suitable implement, forcing the lamination being installed in the direction of the decorative surface segments until a precision fit is established between the adjacent decorative surface segments. The angulated surfaces cooperate to define a camming activity tending to shift the lamination being installed so that a precision fit is established between adjacent decorative segments of the molding assembly.

The camming activity causes high compression force to occur near the juncture of the angulated camming surfaces with the decorative surface segments of the molding. This high compression causes deformation of the wood or other molding material in the region near the decorative surface segments. When subjected to high compression the joints between the adjacent laminations become almost invisible. The tight material deforming fit at the joints extends a significant distance from the decorative surface segments and provides for considerable surface erosion such as by sanding and other surface finishing operations without exposing the joint between the laminations. The camming activity that occurs causes slight separation of the front and rear surfaces of adjoining laminate members. Usually the upper portion of a lamination being installed is tack nailed to the previous lamination and then the lamination is pryed downwardly to its proper precision aligned relationship with the preceding lamination. The uncured adhesive between the cam surface reduces friction between the strips and renders them more easily aligned. When the decorative molding surfaces are precisely aligned the lamination being installed is then securely nailed in place. The adhesive then cures and secures the molding strips in integral assembly. The result is a finished, accurately formed molding assembly having virtually no visible joints at the decorative surface. The adhesive material is of liquid form in its uncured state. When the molding assembly is in its finished form the nails or other securing devices will have been applied such that only those in the last lamination will be visible. These nails or fasteners can be efficiently countersunk and appropriately filled such that they are not visible. The finished molding will need only slight sanding to render it to its finally finished form. If a naturally stained wood molding is desired, such can be accomplished efficiently within the scope of this invention.

BRIEF DESCRIPTION OF THE DRAWINGS

So that the manner in which the above recited features, advantages and objects of the present invention will become apparent and can be understood in detail, a more particular description of the invention briefly summarized above may be had by reference to the embodiments thereof which are illustrated in the appended drawings, which drawings form a part of this specification.

It is to be noted however that the appended drawings illustrate only typical embodiments of the invention and are therefore not to be considered limiting of its scope, for the invention may admit to other equally effective embodiments.

IN THE DRAWINGS

Figure 8:
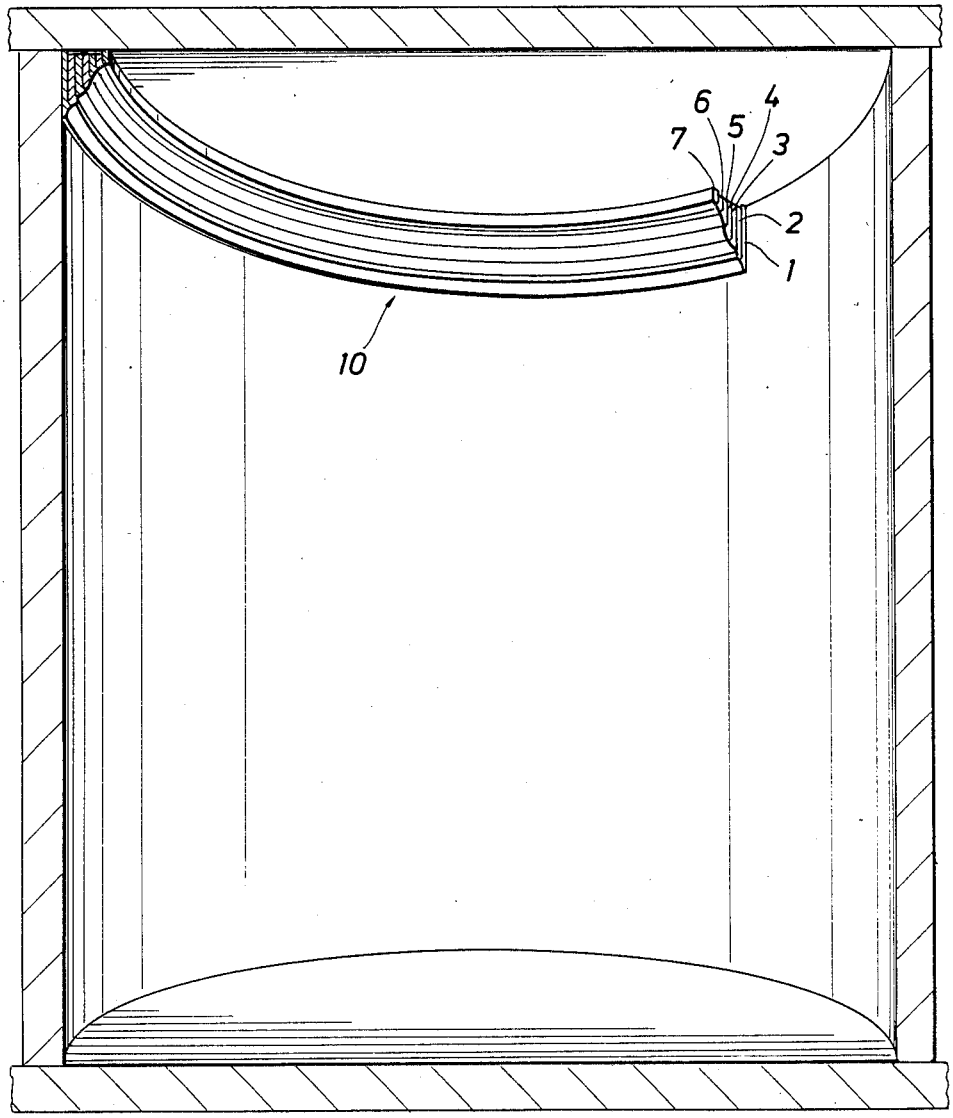

The present invention both as to its organization and manner of operation may best be understood by way of illustration and example when taken in conjunction with the accompanying drawings in which:

FIG. 1 is a sectional view of the several laminations of a split bending crown molding constructed in accordance with the present invention, the various laminations being shown in the order of assembly but in mismatched relation as the same would appear prior to assembly.

FIG. 2 is a sectional view similar to that of FIG. 1 and showing the various laminations connected to a wall structure of a building and assembled in operative relation to form a decorative crown molding assembly.

FIG. 3 is a fragmentary sectional view of a portion of the crown molding assembly of FIG. 2, illustrating relative portions of the molding assembly in the region of the decorative surface of the molding.

FIGS. 4–7 are sectional views of laminated split bending molding representing alternative embodiments of the present invention.

FIG. 8 is a perspective view illustrating the molding at the juncture of a curved wall and a horizontal ceiling.

DETAILED DESCRIPTION OF THE PREFERRED EMBODIMENT

Referring now to the drawings and first to FIG. 1 a laminated split bending crown molding is shown with the various laminations thereof positioned in assembled but not installed relation to illustrate the formation of a decorative molding surface by the various laminations. The laminated crown molding assembly illustrated generally at 10 includes 7 laminations numbered 1–7, each lamination forming a segment of the decorative molding surface of the crown molding. The various laminations may be composed of wood or other suitable molding material and are of relatively thin configuration in order to permit bending thereof to conform precisely to the curvature of the wall surface to which the molding assembly is to be afixed. The laminations are installed in place in the building structure thereby permitting efficient adjustment and positioning of the same to achieve optimum interfitting relation with the building structure. The laminations are provided in long length to permit assembly to the building structure without any particular requirement for the filling of molding joints the thin laminations provide for ready bending of the entire molding assembly to match the curvature of concave or convex wall surface or wall surfaces having compound curvature.

Each of the laminations 1–7 have essentially similar characteristics which permit them to be accurately positioned relative to other laminations. For the purpose of simplicity a major portion of the discussion herein will relate to laminations 1 and 2, it being understood that other laminations are assembled in similar manner. Molding lamination 1 is a base molding strip adapted to be secured to the wall surface of a building structure such as by nailing in the manner shown in FIG. 2. Lamination 1 defines spaced rear surface portion 12 and 14 which are disposed in coplanar relation and which are separated by a relief area 16. Since the molding lamination 1 is the largest lamination in vertical dimension it could be fairly rigid and difficult to bend. The relief area 16 is formed to minimize the cross-sectional modulus of lamination 1 to thus ensure its ready bending to the curvature of the wall surface. The relief area 16 is also provided to reduce the bearing area of the molding against the wall to thus ensure against the possibility that raised areas of the wall do not interfere with positioning of the molding. Also, the relieved area is provided to prevent cupping of the rather wide molding lamination. Molding lamination 1 is cut away at its upper rear corner 18 to provide for relief between the molding and the corner defining the juncture of the wall and ceiling. Any roughness or uneveness in the corner will not interfere with proper positioning of molding laminate 1. The upper surface 20 of molding laminate 1 is intended to establish contact with the ceiling of the building structure, though such is not necessary. At the lower portion of molding laminate 1 exposed decorative surfaces 22 and 24 are formed. Though shown to be of concave, arcuate character when viewed in cross-section, the surface 24 may be of any other suitable configuration within the scope of this invention. Also the planar surface 22 may take any other suitable decorative form within the scope of this invention.

The second and subsequent laminate strips 2–7 are intended to be capable of position adjustment relative to the immediate preceding laminate molding strip to thereby accomplish accurate, precision interfitting relation at its joint with the preceding laminate. It is appropriate therefore to provide each laminate with interacting cam surfaces to thereby permit the laminate strip being applied to be adjustably cammed into proper interfitting relation with the preceding laminate. For this reason, the front surfaces of the laminate strips may be slightly relieved relative to the plumb line defined by the rear surfaces of the strips of the rear surfaces of the strips themselves may be slightly inclined relative to the front surfaces. As a further alterntaive, both the rear and front surface portions of the laminate strips may be slightly angulated with respect to a center-line intended to be substantially plumb relative to the building structure. For purposes of simplicity, the present invention is discussed solely with the front surfaces of the respective laminate molding strips relieved to define angular relation with the rear surface portions and to form the intended camming angles. The angle of relief may be of any suitable character but for purposes of discussion it may be in the order of from 1° to 5° relative to the plane established by the rear surface segments 12 and 14.

As shown in FIG. 1 the respective decorative surfaces of the laminate strips of the molding assembly are mismatched. For precision matching of the decorative surfaces such as 24 of laminate strip 1 and 26 of laminate strip 2 a camming arrangement is most satisfactory. Base laminate strip 1 is provided with an angulated front camming surface 28 while laminate strip 2 is provided with an opposed rear facing camming surface 30. With the laminate strips in loosely assembled relation as shown in FIG. 1 or lightly tack nailed, the rear surface 32 of strip 2 is in contact with the front surface 34 of laminate strip 1. The camming surfaces 28 and 30 are disposed in angulated relation, touching only near the outer portions thereof as shown in FIG. 1. The molding strips 2–6 define upper surfaces such as shown at 36 of molding strip 2 which are intended to be disposed in spaced relation with the ceiling of the building structure such as is evident from FIG. 2. A pry bar or other suitable manipulating device is positioned between the ceiling and the upper surface 36 of molding strips 2–6 and a force is applied in a direction urging the molding strip in a direction toward the decorative surface thereof. The angular relief of the front surface 34 of molding strip 1 to the rear surface plane thereof is such as to define a particular spacing of the angles defined by juncture of the camming surfaces 28 and 30 with the respective surfaces 32 and 34 of adjacent molding strips. These angles, shown at 38 and 40 in FIG. 3 are designed to be appropriately spaced when the molding strip being applied is properly positioned relative to the adjacent previously applied molding strip. For example in a split bending crown mold assembly where the initial molding strip or laminate 1 has a vertical height of 3¼" the spacing between corner edges 38 and 40 will be in the order 1/32". This corner spacing can be typical for all sizes of molding simply by controlling the relative angles of the front and rear surfaces.

As a pry bar is applied against the upper surface 36 of the second molding strip 2 and a downward force is applied to urge molding strip downwardly, the cam surfaces 28 and 30 react at the outermost portion thereof to bring the adjacent decorative surfaces 24 and 26 into precise registry. As this camming force is applied, the wood or other molding material, being rather soft, is deformed by compression that occurs. Thus, the wood or other material forms an extremely tight joint extending well away from the decorative surfaces as is evident at 42 in FIG. 3. This joint closure activity by deforming of the molding material permits the finished crown molding to be sanded even down to the broken line shown in FIG. 3 without opening the joint. In other words, significant surface finishing may be accomplished without causing the joints to be noticeable. Precision alignment of the decorative surface segments usually renders all but very light surface finishing unnecessary.

To assist in the camming activity and to provide for the formation of an integral, finished assembly after the molding assembly operation has been completed, a quantity of adhesive material is applied to the camming surfaces 28 and 30 as well as to the opposed surfaces 32 and 34 of the adjacent molding strips. The adhesive material functions in its liquid uncured state as a lubricant to thereby aid the worker in accurately positioning the adjacent molding strips. After the adhesive material has become cured it functions to secure the molding strips in an integral molded assembly.

Installation

As mentioned above, the molding assembly is installed in place on the building structure. Molding base strip 1 is placed against the wall 44 as shown in FIG. 2 and is nailed in place by means of nails 46 of any other suitable fastener devices. If desired, a quantity of fairly viscous liquid adhesive material 47 may also be placed between the wall surface 48 and the rear surface segments 12 and 14. A quantity of the slow drying adhesive material is then applied to the rear surface 32 of the second molding strip or to the front surface 34 of molding strip 1 or both and molding strip 2 is placed in assembled relation with molding strip 1 in the manner shown in FIG. 1. In this position the molding strip being applied is tack nailed in place. For precision alignment of the decorative surfaces 24 and 26 so as to form a substantially invisible joint at 42 a pry bar is inserted into the space between the upper surface 36 of molding strip 2 and the ceiling surface 50. A prying force is applied to urge the molding strip 2 downwardly to thus bring decorative surface 26 into precision alignment with decorative molding surface 24. When such alignment has been accomplished nails or other suitable fasteners are utilized to firmly secure molding strip 2 to molding strip 1. Obviously, the adhesive material is yet uncured when the molding strips are nailed in position in this manner. Molding strip 3 is then applied in like manner by first applying adhesive material to the adjacent surfaces to be brought into assembly. Since the previous molding strip 2 has been secured in place by nails or other suitable fasteners a pry bar may then be inserted between the upper surface 52 of molding strip 3 and a downward prying force is applied to being decorative surface 54 of molding strip 3 into precise alignment relative to the adjacent decorative surface of molding strip 2. Again, sufficient force is applied to deform the molding material at the joint in the manenr illustrated in FIG. 3 thus providing for considerable surface finishing if desired without opening the joint between molding strips 2 and 3.

The remaining molding strips 4,5 and 6 are applied in similar fashion. Each being nailed to previously applied strips in the presence of an adhesive material which also functions as a lubricant to achieve efficient camming activity. As the last or cap molding strip 7 is applied it is also cammed into properly positioned relation with the preceding molding strip 6 forming a similar tight joint and accurately positioned decorative surfaces. Cap molding strip 7 is intended to extend to the ceiling surface 50 thus closing the space between the upper surfaces of molding strips 2–6 with the ceiling surface. Since the sectional modulus of molding strip 7 is minimal, it can be pryed downwardly by means of a relatively thin prying device. Any slight gap that exists between the upper surface of molding strip 7 and the ceiling surface 50 may be filled with a minimal quantity of filler material. Since the nails 46 of molding strip 7 will have the head portions thereof exposed, these nails will simply be countersunk in the usual manner and the holes filled. After the crown molding assembly has been installed in this manner, the joints thereof will be almost invisible and the resulting molding assembly will require very little surface preparation in order to render it to excellent, pleasing appearance.

In the past, laminated crown molding and other such moldings have been difficult to accomplish because sectioning of molding into thin strips frequently yields thin, almost knife-like edges on adjacent molding strips. When the molding strips are assemblied or when sanding or other finishing operations occur the knife-like edged portions of the strips tend to become worn away quite rapidly while the more abrupt surface portions of the molding strips tend to resist erosion by sanding. The result is an uneven, very noticeable joint that is unsatisfactory. Significant filing and surface preparation must then be accomplished to render the resulting molding assembly to an acceptable form. According present invention, the angulated camming surfaces 28 and 30 are so oriented relative to the decorative surfaces 24 and 26 that the resulting joint at the decorative surface is defined by rather abrupt angles. For example, surface 28 is positioned at an angle of about 45° in relation to the plumb line defined by rear surface segments 12 and 14. The opposite cam surface 30 is angulated with respect to camming surface 28 such that proper spacing is achieved at the corners 38 and 40 as shown in FIG. 3. These angulated surfaces are so oriented that they vary only about a maximum of 10° either side of a right angle.

FIGS. 4, 5, 6 and 7 disclose other corner molding designs which may be formed of various laminated strips of molding material. This will permit long corner moldings such as box cornices of rather complex design to be developed which would otherwise not be practical under circumstances where wall surfaces are of convex or concave configuration.

Although planar cam surfaces have been discussed in detail herein, such is not intended to limit this invention. In FIG. 4 three different types of camming joints are illustrated. In each case the joint line is substantially perpendicular to the angle of the molding. At A is shown a joint as described herein. At B is shown a curved camming joint and at C the camming joint is in the form of a compound angulation.

In view of the foregoing, it is apparent that this invention is one well adapted to attain all of the objects and advantages hereinabove set forth together with other advantages which will become obvious and inherent from a description of the apparatus itself. It will be understood that certain combinations and subcombinations are of utility and will be employed without reference to other features and subcombinations. This is contemplated by and is within the scope of the present invention.

What is claimed is:

1. A split bending molding assembly for use in curved and straight walled building structures, comprising:

(a) a plurality of molding strips which are assembled to the interior corners of intersecting straight and curved building surfaces and are bent to substantially fit the profile thereof to form an interior corner molding of desired decorative configuration, each molding strip forming a decorative surface segment;

(b) cooperative cam surface means being formed by each adjacent pair of said molding strips and forming a tapered relation converging toward said decorative surface segment, upon movement of one of said molding strips relative to an adjacent molding strip in a direction substantially parallel to one of said building surfaces said cooperative cam surface means having camming reaction with one another for inducing precision alignment of said decorative surface segments of said adjacent molding strips.

2. A split bending molding assembly as recited in claim 1, wherein:

at least some of said molding strips defined rear surface means and front surface means disposed in angulated relation of at least 1° when said molding strips are fixed in assembly.

3. A split bending molding assembly as recited in claim 2, wherein:

(a) said wall defines said curved building surface and said rear surface means of at least one of said molding strips is intended to be positioned in parallel relation with the plumb line of said wall; and (b) said front surface means is disposed in angulated relation with said rear surface means and adapted to be disposed in similarly angulated relation with said plumb line.

4. A split bending molding assembly as recited in claim 1, wherein said molding assembly comprises:

(a) a base molding strip defining angularly related front and rear surface means and a decorative surface segment, said base molding strip further defining a cam surface intersecting said front surface means and said decorative surface segment;

(b) a plurality of secondary molding strips each defining angularly related front and rear surface means and each forming a decorative surface segment and forming front and rear cam surface means, a front cam surface means of one molding strip being disposed in angular relation with the rear cam surface means of the adjacent molding strip forming said tapered relation and reacting with said rear cam surface means of said adjacent molding strip to achieve precise alignment of adjacent decorative surface segments upon said relative movement of said adjacent molding strips; and (c) a cap molding strip defining a rear surface and a rear cam surface disposed in angular relation and also forming a decorative surface segment.

5. A split bending molding assembly as recited in claim 4, wherein:

said rear surface means of said base molding strip is adapted to be positioned in alignment with the plumb line of the wall to which said base molding strip is to be affixed.

6. A split bending molding assembly as recited in claim 4, wherein:

said cam surface means of adjacent molding strips are disposed in angular relation and when positioned in assembly intersect at said decorative surface segments of said adjacent molding strips.

7. A split bending molding assembly as recited in claim 4, wherein:

said cam surface means of adjacent molding strips are oriented along a plane intersecting the respective decorative surface segment at an abrupt angle.

8. A split bending molding assembly as recited in claim 7, wherein:

said abrupt angle is in a range varying not more than about 10° either side of a right angle.

9. A split bending molding assembly for use in curved and straight walled building structures, comprising:

(a) a plurality of molding strips which are adapted to be assembled to the interior corners of intersecting straight and curved building surfaces and are bent to substantially fit the profile thereof to form an interior corner molding of desired decorative configuration, each molding strip forming a decorative surface segment;

(b) cooperative cam surface means being formed by each adjacent pair of said molding strips and converging toward said decorative surface segment upon movement of one of said molding strips relative to an adjacent molding strip in a direction substantially parallel to one of said building surfaces, said cooperative cam surface means reacting with one another and inducing precision alignment of said decorative surface segments of said adjacent molding strips, at least some of said molding strips defining rear surface means and front surface means disposed in angulated relation when said molding strips are fixed in assembly.

10. A split bending molding assembly as recited in claim 9, wherein:

said front surface means of at least one of said molding strips intersects said cooperative cam surface means of said at least one of said molding strips and is disposed in angular relation therewith.

11. A split bending molding assembly as recited in claim 9, wherein:

upon assembly said front and rear surfaces of adjacent molding strips touch only in the region of the extremities thereof remote from said decorative surface segments thereof.

12. A split bending molding asesmbly for use in curved and straight walled building structures, comprising:

(a) a plurality of molding strips which are adapted to be assembled to the interior corners of straight and curved building surfaces and bent to fit the profile thereof to form a crown molding of desired decorative configuration, each molding strip forming a decorative surface segment;

(b) cooperative cam surface means being formed by each adjacent pair of said molding strips, said cooperative cam surface means forming a taper converging toward said decorative surface segment, upon movement of one of said molding strips relative to the adjacent molding strip said cooperative cam surface means reacting with one another for inducing precision alignment of said decorative surface segments of said adjacent molding strips;

(c) said molding strips being formed of deformable molding material; and (d) said cooperative cam surface means are subjected to high compression during reaction thereof and during cammed assembly are deformed in the region of the juncture of said cam surface means with said decorative surface segment, thus forming a tight high compression joint extending from said decorative surface segment to a location spaced from said decorative surface segment.

13. A method for assembly of a split bending crown molding including a base molding strip and a plurality of secondary strip means, each defining front end rear surfaces on edge surface and a decorative surface and attachment thereof to a building structure having curved walls intersecting a ceiling, comprising:

(a) bending said base molding strip to a desired curved configuration and attaching it in registering assembly with a curved wall with the upper edge thereof in contact with the ceiling;

(b) bending secondary molding strip means to the configuration of said base molding strip;

(c) attaching said secondary molding strip means to said base molding strip;

(d) causing camming movement of said secondary molding strip means relative to said base molding strip means, said camming movement causing precision alignment of said secondary molding strip means with said base molding strip; and (e) firmly securing said secondary molding strip means to said base molding strip means.

14. A method as recited in claim 13, including:

applying an adhesive material to at least one of said base molding strip and secondary molding strip means prior to attaching said secondary molding strip means to said base molding strip, said adhesive material being in liquid form and functioning as a lubricant during said camming movement and adhering said molding strips in integral assembly upon curing.

15. A method as recited in Claim 13, wherein:

a plurality of said secondary strip means are utilized to form said split bending crown molding, said secondary molding strips each being assembled to previously installed strips in serial manner and each being moved to precision interfitting relation by camming movement prior to said firmly securing thereof.

* * * * *